US006533681B2

(12) United States Patent
Inoue et al.

(10) Patent No.: US 6,533,681 B2
(45) Date of Patent: Mar. 18, 2003

(54) GOLF CLUB HEAD

(75) Inventors: Akihisa Inoue, 35-11-806, Kawauchi-moto-hasekura, Aoba-ku, Sendai-shi, Miyagi-ken (JP); Hisashi Kakiuchi, Kobe (JP); Yoshishige Takano, Kobe (JP)

(73) Assignees: Akihisa Inoue, Miyagi-ken (JP); Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 09/852,678

(22) Filed: May 11, 2001

(65) Prior Publication Data

US 2001/0051549 A1 Dec. 13, 2001

(30) Foreign Application Priority Data

May 12, 2000 (JP) ..... 2000-140682

(51) Int. Cl.[7] ..... A63B 53/04
(52) U.S. Cl. ..... 473/342; 473/345; 473/349
(58) Field of Search ..... 473/324, 329, 473/332, 342, 349, 347, 348, 345, 346

(56) References Cited

U.S. PATENT DOCUMENTS 4,928,965 A * 5/1990 Yamaguchi
5,089,067 A * 2/1992 Schumacher
5,620,382 A * 4/1997 Cho
6,196,936 B1 * 3/2001 Meckel

* cited by examiner

*Primary Examiner*—Sebastiano Passaniti
(74) *Attorney, Agent, or Firm*—Birch, Stewart, Kolasch & Birch, LLP

(57) ABSTRACT

A golf club head comprises a face part defining a face for striking a golf ball, and at least a part of the face part made of an alloy satisfying the following three conditions: (1) the alloy is composed of at least three different metallic elements whose group numbers in the periodic system are at least two consecutive numbers; (2) a difference in the atomic radius between at least two of said at least three different metallic elements is not less than 10%; and (3) the heat of mixing of the element that is the major component of the alloy and at least one of the remaining components or the remaining component is not less than −10 kcal/mol.

8 Claims, 5 Drawing Sheets

GOLF CLUB HEAD

BACKGROUND OF THE INVENTION

The present invention relates to a golf club head, more particularly to an improved structure of a ball striking face.

In the laid-open Japanese patent application No. JP-A-8-224328, an impedance matching theory is disclosed. According thereto, if the PLM frequency of a golf club head matches that of a golf ball, then an energy loss is minimized, namely the energy that the golf ball may receive from the golf club head when struck is maximized and the restitution coefficient may be increased, and therefore, the leap is maximized. Here, the "PLM frequency" of an object is the frequency at which the primary local minimum of the mechanical impedance thereof occurs. Incidentally, the mechanical impedance Z is defined as the quotient F/V of the magnitude of an external force F acting upon a point of a body divided by the resultant velocity V of another point of the same body.

The PLM frequencies of the widely used golf balls are about 1000 Hz. In general, however, the PLM frequencies of conventional golf club heads are higher than 1000 Hz. Thus, it is the best way to decrease the club head's PLM frequency near to 1000 Hz.

The PLM frequency of a golf club head may be decreased if a face part of the club head is decreased in the thickness and/or the face part is made of a material having a lower Young's modulus. Here, the face part is a front part of the head, which defines the face for striking a gall ball.

In recent years, on the other hand, wood clubs having a head whose major part is made of a metallic material such as stainless, titanium alloy and the like (hereinafter the "wood-shaped metal head" or "wood-shaped head") are widely used. In particular, titanium alloys are at present the mainstream of the wood-shaped metal heads because of their strength and relatively low specific gravity.

There is a tendency for such wood-shaped metal heads to have a weight distribution such that the sole part or heel part is heavier than other parts, and in order to realize such weight distribution without increasing the total weight of the head, the thickness of the face part is minimized. Thus, it is very difficult to further decrease the thickness of the face part.

As to materials having a low Young's modulus, usually the tensile strength and hardness of such material are low when the Young's modulus is low. Accordingly, if the face part is made of such material, it is difficult to decrease the thickness of the face part in order to lower the PLM frequency.

SUMMARY OF THE INVENTION

It is therefore, an object of the present invention to provide a golf club head in which, by making at least a part of the ball hitting face of a special alloy which has a higher strength and lower Young's modulus than ever, the PLM frequency of the ball striking face is decreased toward those of the golf balls to improve the restitution coefficient without sacrificing the durability of the face part.

According to the present invention, a golf club head comprises a face part defining a face for striking a golf ball, the face part is at least partially made of an alloy satisfying the following three conditions:

(1) the alloy is composed of at least three different metallic elements whose group numbers in the periodic system (or family numbers in the periodic table of the elements) are at least two consecutive numbers;

(2) a difference in the atomic radius between at least two of the at least three different metallic elements is not less than 10%; and (3) the heat of mixing of the element that is the major component of the alloy and at least one of the remaining components or the remaining component is not less than −10 kcal/mol.

As to the group numbers or family numbers of the elements, sequential numbers from 1 to 18 are used in the following description. Incidentally, this numbering system corresponds to the other well-known numbering system starting from 1A to 0 as follows.

1(1A), 2(2A), 3(3A), 4(4A), 5(5A), 6(6A), 7(7A), 8(8), 9(8), 10(8), 11(1B), 12(2B), 13(3B), 14(4B), 15(5B), 16(6B), 17(7B), 18(0)

DESCRIPTION OF THE PREFERRED EMBODIMENTS

Figure 1:
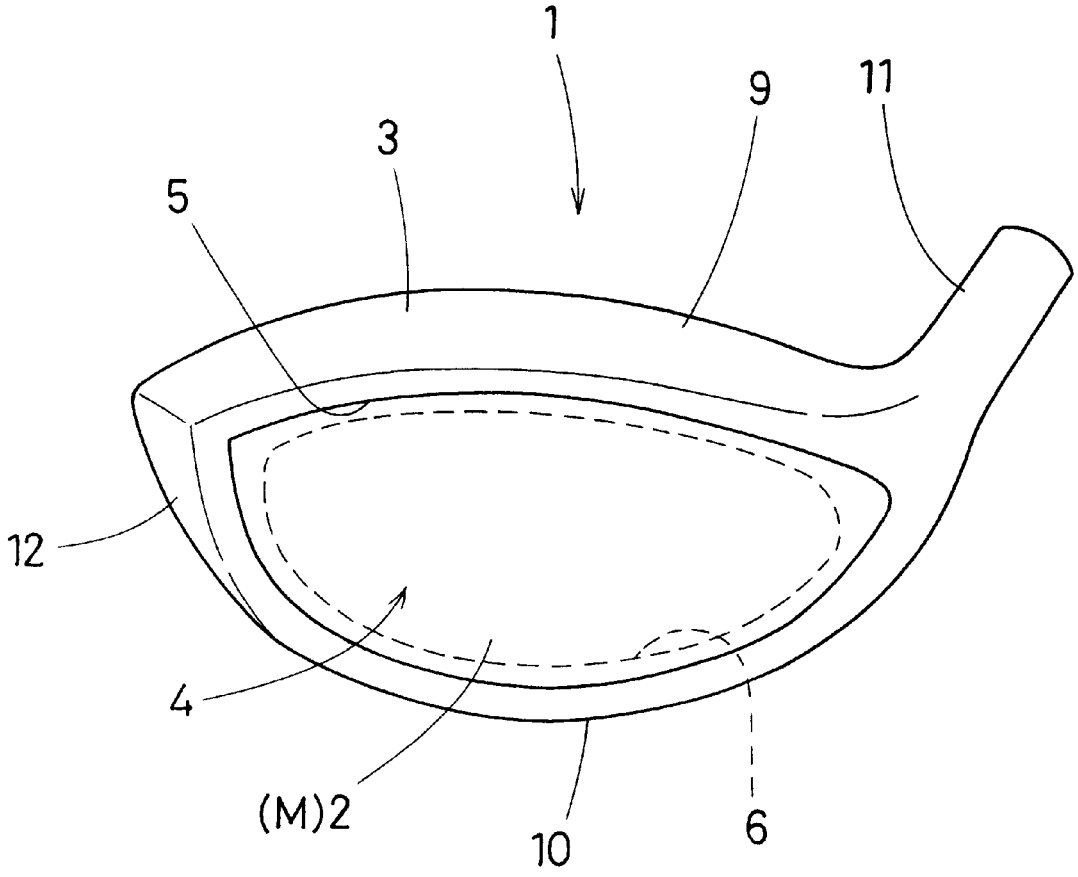
FIG. 1 is a front view of a golf club head according to the present invention.

Embodiments of the present invention will now be described in detail in conjunction with the accompanying drawings.

According to the basic knowledge of crystalline metallic materials, the Young's modulus of such a crystalline metallic material increases as the atomic bonding force of the material increases, and the increased bonding force may increase the yield strength and hardness of the material. Further, it has been known that the crystalline metallic materials have a critical elastic elongation of less than about 0.5%, and if the elongation is over this critical limit, the material has a plastic deformation and accordingly can not return to its former shape.

A material opposite to the basic knowledge, namely a crystalline metallic material whose yield strength and hardness are high and Young's modulus is low was believed to be unavailable. However, the present inventors was discovered that, contrary to the basic knowledge, crystalline alloys satisfying the following three conditions (1), (2) and (3) have a very low Young's modulus and a high critical elastic elongation and high critical plastic elongation while maintaining a high tensile strength and high hardness. Therefore, the inventors could accomplish a golf club head in which, by making at least a part of the ball hitting face of such alloy, the PLM frequency is decreased near to the golf balls' PLM frequencies and the restitution coefficient between the head and ball can be improved, while maintaining the full durability in the face part and the like.

(1) The crystalline alloy is composed of at least three different metallic elements whose group numbers in the periodic system are at least two consecutive numbers.

(2) A difference in the atomic radius between at least two of the metallic elements is not less than 10%.

(3) The heat of mixing of the element that is the major component of the alloy and at least one of the remaining components or the remaining component is not less than −10 kcal/mol.

The mechanical properties specific to this novel alloy are brought by the above-mentioned three conditions (1), (2) and (3) which are closely related to each other. However, it may be said that: the principal factor in the high strength and high hardness of the alloy is the condition (2) which leads to the strengthening by solid solution of the elements which have a relatively large difference in the atomic radius therebetween; the principal factor in the low Young's modulus of the alloy is the condition (3) which lessens the interaction between the elements due to the attraction therebetween and allows the atoms to move reversibly with less stress; and the principal factor in the heightened critical elastic elongation is the condition (1) which leads to a great variety of sites to which atoms can move reversibly because a plural elements having less interaction therebetween exist, and atom's reversible movements reach to a high stress area, which make it difficult to raise the deformation stress.

According to the present invention, the alloy used in the face part of the golf club head is a solid solution of at least three metallic elements that are evenly dispersed. With respect to the group numbers in the periodic system, these metallic elements have at least two consecutive group numbers. Thus, various combinations are possible. For instance, a combination of two metallic elements in group-4 and a metallic element in group-5; a combination of a metallic element in group-4, a metallic element in group-5 and a metallic element in group-6, etc., are possible.

Owing to the consecutive group numbers, it becomes possible for the alloy to take a state such that the metallic elements do not firmly bond together.

If the number of the metallic elements is less than three, the atoms' reversible movements can not reach to a high stress area. It may be preferable that the number of the metallic elements is limited to at most nine for a practical reason. However, the number may be more than nine as far as the conditions (1), (2) and (3) are satisfied.

Metallic elements in group-4 through group-6 are preferably used as the metallic elements constituting the alloy because the bonding force therebetween decreases under a state of solid solution and thereby it becomes possible to further decrease the Young's modulus.

At least two of the metallic elements, which constitute the alloy, have a relatively large difference in the atomic radius, which is at least 10%, whereby strengthening due to solid solution is caused and the alloy is provided with heightened strength and heightened hardness. Further, atomic rearrangement hardly occurs and the diffusing power decreases. Therefore, even if the cooling of the solution is slow, it is possible to obtain a nonequilibrium solid solution which is a body-centered cubic solid solution (single phase) or which mainly includes a body-centered cubic solid solution. Such a solid solution can be easily provided with a higher strength by utilizing the work hardening by cold working as explained later. If the atomic radius difference is less than 10%, the above-mentioned excellent mechanical characteristics of the alloy can not obtained.

Thus, the difference in the atomic radius is set to be not less than 10% as explained above, preferably in a range of from 10 to 14%, more preferably in a range of from 11 to 12%. This condition must be satisfied by at least one combination of two elements, preferably every combination of two elements. If the atomic radius difference is more than 15%, it becomes difficult to form a wide variety of solid solution due to dimensional factor.

Here, the atomic radius difference is defined as $$\{(ra-rb)/ra\}\times 100$$

wherein ra and rb are the atomic radii of two elements (rb<ra). Incidentally, the atomic radius can be known from the publications such as "Metal Data Book" published by The Japan Institute of Metals.

In general, the heat of mixing of two metallic elements whose group numbers are consecutive is a positive value or a value in a range of 0 to −10 kcal/mol, and the elements are liable to repel each other.

If the group numbers are not consecutive, the heat of mixing becomes less than −10 kcal/mol (for instance −15 kcal/mol), and the attraction between the atoms increases which makes it very difficult to achieve a low Young's modulus. Further, cracks are liable to occur during cold working (rolling). Furthermore, there is a possibility that an intermetallic compound is produced.

For example, the heat of mixing of Ti and Ni is −12.4 kcal/mol that is less than −10 kcal/mol. In this case, due to a mutual attraction therebetween, the Young's modulus can not be decreased. Further, there is a possibility that an intermetallic compound is formed, and there is a tendency such that it becomes difficult to make an alloy mainly including a body-centered cubic solid solution. From this viewpoint, the heat of mixing is preferably set in a range of not less than −5 kcal/mol, more preferably not less than 0 kcal/mol. As a result, as to the interatomic bond of the alloy, the atoms have a tendency to repel each other rather than attract each other. Therefore, it becomes possible for the atoms to make reversible movement under less stress, and a low Young's modulus that could not be obtained until now can be obtained. The heat of mixing can be determined by the heat of reaction measured with a differential scanning calorimeter manufactured by PerkinElmer Corporate.

It is preferable that the alloy includes at least 50 volume percents of body-centered cubic solid solution with respect to the total volume of the alloy. If less than 50 volume percents, cold working properties deteriorate and the Young's modulus is increased. From this viewpoint, the body-centered cubic solid solution is preferably not less than 80 volume percents, more preferably not less than 95 volume percents.

In order to set the volume percentage in this range, body-centered cubic elements in Group-4 through Group-6 are preferably used. For the remainder of the alloy, solid solutions having various crystal structures, e.g., hcp (hexagonal close-packed lattice) ($\alpha$ phase), $\omega$ phase which is a metastable phase, etc., may be used. The volume percentage of the body-centered cubic solid solution is defined by an X-ray diffraction peak strength ratio (integral calculus).

Even if the titanium content is less than 50 atom %, the above-mentioned excellent mechanical characteristics may be obtained. But, there is an increasing tendency in the specific gravity and melting point. Therefore, if such alloy is used in the golf club head, the weight and cost increase. From this viewpoint, a titanium-base alloy including at least 50 atom % of titanium Ti is preferably used. As to the other component(s), it is preferable that the alloy includes zirconium Zr and/or hafnium Hf (hereinafter the metal "M1") whose total content is less than 50 atom %.

If neither Zr nor Hf is included, it is difficult to make the solid solution from a large amount of metallic elements having a large difference in the atomic radius while satisfying the condition (3). Thus, it becomes difficult to take the advantage of the strengthening due to the solid solution.

On the other hand, if the total content of the M1 exceeds 50 atom %, the specific gravity and melting point of the alloy are increased.

Further, the alloy preferably includes at least one element selected from Vanadium V, niobium Nb, tantalum Ta, molybdenum Mo, chromium Cr and tungsten W (hereinafter the metal "M2") whose total content is less than 50 atom %. If none of these elements is included, the formation of body-centered cubic solid solution by slow cooling is difficult, and the strength and corrosion resistance tend to decrease. If the total content of the metal M2 exceeds 50 atom %, the specific gravity, melting point and cost of the alloy increase.

This titanium-base alloy may be expressed by the following composition formula:

$$Ti_{100-x-y}M1_xM2_y$$

wherein

M1 is Zr and/or Hf,

M2 is at least one element selected from V, Nb, Ta, Mo, Cr and W, 0<x<50, 0<y<50, x+y=<50 (x, y and 100−x−y are expressed in atom %).

It is preferable that the alloy is hardened by means of cold working, e.g. rolling, drawing, forging, extrusion, deep drawing and the like, wherein the decrease in the sectional area of the alloy due to the cold working must be not less than 10%, preferably not less than 30%, more preferably not less than 50%, still more preferably not less than 70%. Therefore, the tensile strength can be further improved by the work hardening while maintaining a low Young's modulus.

For instance, by the cold working including rolling and drawing, a Ti—Zr-base alloy of which composition formula is $Ti_a$ $Zr_b$ $Nb_c$ $Ta_d$ (a=100−x−y, b=x and c+d=y) can be provided with a yield strength of 980 MPa, tensile strength of 1070 MPa, Young's modulus of 40 GPa, critical elastic elongation of 1.7%, and Vickers hardness of 350 Hv.

These characteristics of this Ti—Zr-base alloy are shown in Table 1 together with those of pure titanium and titanium alloy (Ti-6Al-4V) that is widely used in the wood-shaped metallic head. Further, the tensile stress-elongation curves of these materials are shown in FIG. 5.

TABLE 1

| | pure titanium | Ti—6Al—4V | Ti—Zr alloy |
|---|---|---|---|
| Young's modulus E (GPa) | 102 | 110 | 40 |
| Tensile strength σ f (MPa) | 345 | 910 | 1070 |
| Yield strength σ v (MPa) | 275 | 840 | 980 |
| Critical elastic elongation (%) | 0.3 | 0.5 | 1.7 |
| Critical plastic elongation (%) | 20 | 18 | 15 |
| Vickers hardness Hv | 100 | 260 | 350 |

Figure 5:
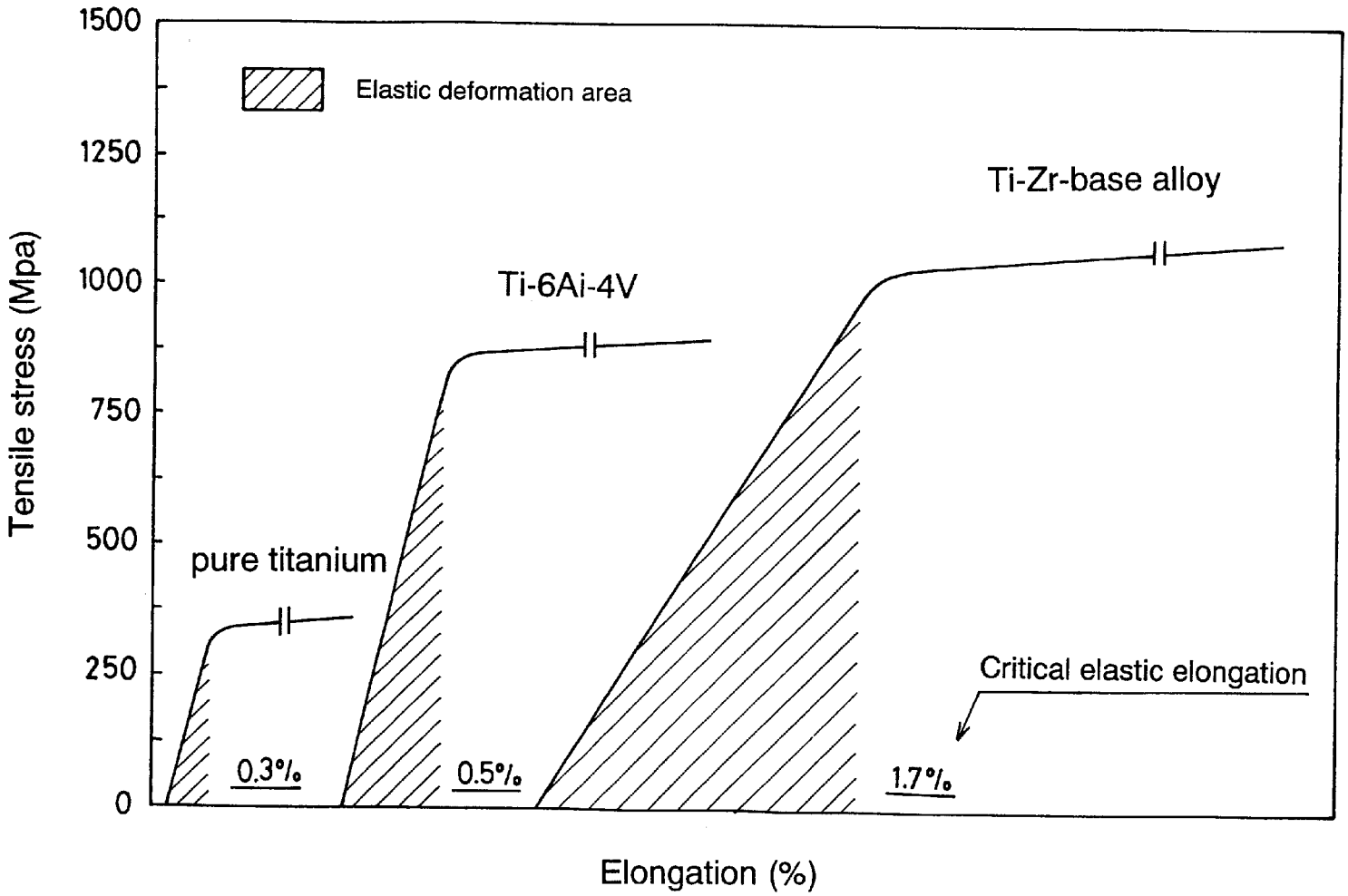
FIG. 5 is a graph showing tensile stress-elongation curves of various alloys.

As apparent from Table 1 and FIG.5, although the Ti—Zr-base alloy has a tensile strength of σ f higher than those of pure titanium and Ti-6Al-4V titanium alloy, the Young's modulus E is decreased to about 40 MPa which is less than 50% of them, while maintaining a large critical elastic elongation and high hardness. By using the alloy having such heightened strength and lowered Young's modulus in making the face part of the golf club head, the PLM frequency can be decreased without sacrificing the durability and resistance to external injury of the face. As a result, the restitution coefficient at the time of striking the ball is improved, and the initial speed of the ball is increased to increase the lap.

Figure 6:
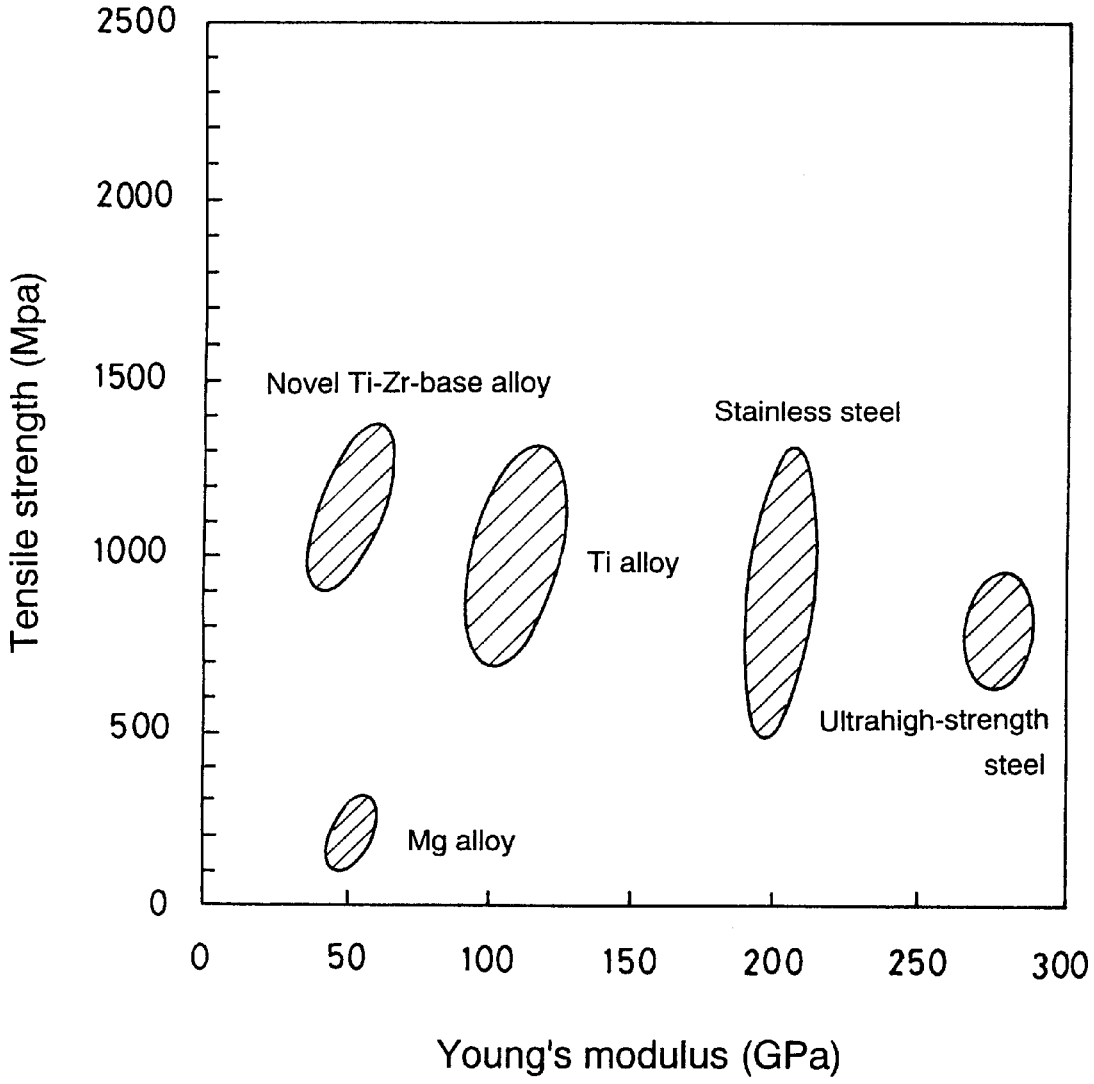
FIG. 6 is a graph showing a distribution of the alloys in connection with the tensile strength and Young's modulus.

In FIG. 6, the position of the newly developed Ti—Zr-base alloy greatly shifts from that of the conventional crystal alloy.

The alloy can be manufactured by utilizing a usual arc melting furnace. After the melting, the alloy includes the body-centered cubic solid solution (β phase) having a low Young's modulus. Further, by the above-mentioned cold working, the strength and hardness of the alloy can be further increased.

When the difference in the specific gravity between the elements is relatively large, in order to prevent the segregation of the elements, a quenching treatment is preferably made.

The ratio (σf/E) of the tensile strength σf to the Young's modulus E of the alloy is preferably set in a range of from 0.0125 to 0.030, more preferably 0.018 to 0.025, whereby the face part may have a relatively large elastic deformation although it has a sufficient strength. Thus, it becomes possible to decrease the PLM frequency near to the golf balls' PLM frequencies to increase the carry.

It is important that the above-mentioned alloy forms the major part of the ball hitting face 4. Thus, the ratio (S2/S1) of the surface area S2 formed by the alloy to the total surface area S1 of the ball hitting face is not less than 0.5, preferably more than 0.7, and more preferably more than 0.9. Preferably, the sweet spot is included in this major part as the center thereof.

As to the method of forming the face part, either of the following two methods is possible: 1) to make a face plate 2 as the face part of the alloy which occupies the major part of the face 4 and fix it to the main body 3 of the head 1 by bonding, welding, caulking and/or the like; or 2) to make the head 1 (the whole inclusive of the face part) out of the alloy. When the whole of the head 1 is made of the alloy, the strength and restitution coefficient may be further improved. Viewed in this light, the method 2) is preferable.

The thickness (t) of the face part made of the alloy is set in a range of from 1.5 to 4.0 mm, preferably 1.5 to 2.9 mm, more preferably 1.5 to 2.4 mm. To adjust the thickness (t), the back of the face 4 is preferably formed as a closed hollow or a open hollow.

Because of the multiplier effect of the lowered Young's modulus of the alloy and the easy elastic deformation of the face part owing to the decreased thickness (t) of the face part which becomes possible by the heightened strength, it is possible for the PLM frequency of the head to further approach to the golf balls' PLM frequencies.

Preferably, the product (E×t) of the thickness t (mm) and Young's modulus E (GPa) is set in a range of from 40 to 300 (GPa mm).

If the thickness t (mm) is too small, the strength of the face decreases. As explained above, the carry of the ball increases with the Young's modulus decreases. Therefore, the product (E×t) is preferably set in a range of not more than 250 (GPa mm), more preferably not more than 200 (GPa mm).

In case that the face plate is used, if the Young's modulus is too small, the deformation of the face plate when hitting the ball is large. As a result, the strength tends to become insufficient at the junction or boundary between the face plate and the main body of the head.

From this viewpoint, the (E×t) is preferably not less than 40 (GPa mm), more preferably not less than 60 (GPa mm), still more preferably not less than 80 (GPa mm). These lower limits for the product (E×t) can be used in combination with any one of the above-mentioned upper limits.

The products (σf×t) of the thickness t(mm) and the tensile strength σf(GPa) of the alloy is preferably set in a range of from 1.0 to 4.0 (GPa mm), more preferably 1.5 to 3.5 (GPa mm), still more preferably 2.0 to 3.5 (GPa mm).

When the tensile strength σf becomes higher, the strength of the face part also becomes higher. Therefore, the thickness of the face part can be reduced correspondingly. As the thickness of the face part decreases, the rigidity of the face part decreases and the carry may be increased. If the tensile strength σf is fairly high, the thickness may be fairly decreased while satisfying the limitation of the product (σf×t). If the tensile strength σf is fairly low, the thickness (t) is increased within the above-mentioned range of the product (σf×t) to maintain the strength and durability of the face.

Figure 2:
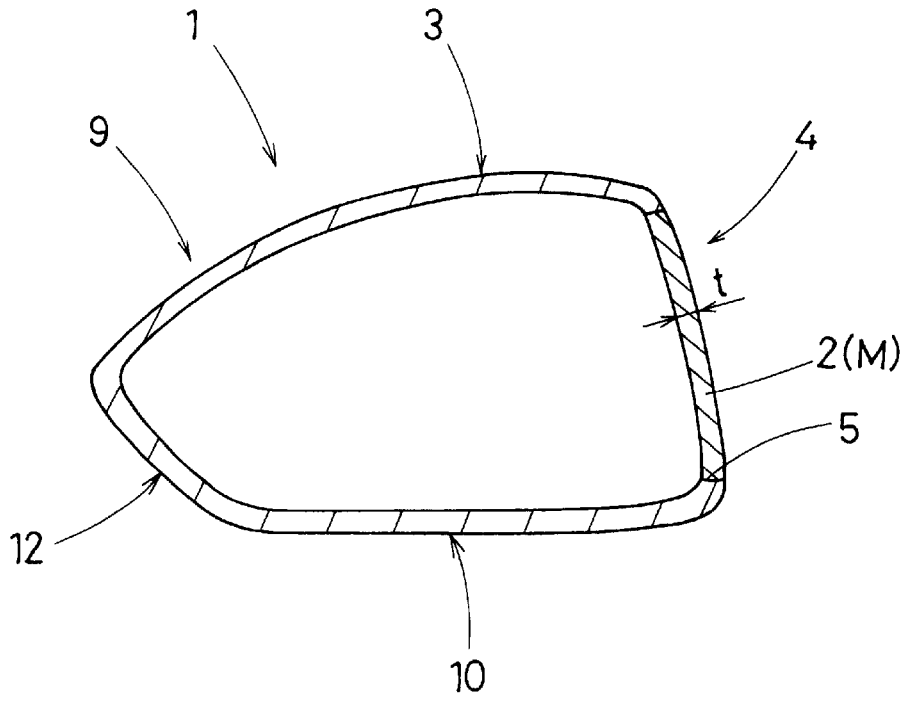
FIG. 2 is a cross sectional view thereof showing an example of the mounting of a face plate.

FIG. 1 and FIG. 2 show a wood-shaped club head according to the present invention.

The head 1 is hollow and comprises a main body 3 and a face plate 2 defining the face 4 for striking a golf ball, wherein the main body 3 is provided in the front thereof with an opening 5, and the face plate 2 is disposed in the front of the main body 3 so as to close the opening 5.

The face plate 2 is made of an alloy M satisfying the above-mentioned conditions (1), (2) and (3) which is, in this example, a Ti—Zr-base alloy in a four-component system of $Ti_a\ Zr_b\ Nb_c\ Ta_d$, wherein a=100−x−y, b=x and c+d=y.

The face plate 2 can be made by melting all of the four component elements in an arc melting furnace in which the air therein is replaced by argon, shaping the molten metal into an ingot having a diameter of 100 mm and a thickness of 10 mm or an ingot having a diameter of 20 mm and a length of 100 mm, and cold rolling the ingot so that the decrease in the sectional areas becomes in the range of from 50 to 70%.

In the cold rolling, it is preferable that the thickness is decreased to the target thickness in a plurality of stages using multiple rollers. In this embodiment, the thickness of the face part or the face plate 2 is almost 3 mm.

As the alloy has a sufficient tensile strength, even if the size of the face plate is increased, a problem in the strength hardly arises. Thus, the surface area S2 of the face plate 2 is preferably set in a range of not less than 10 sq.cm, more preferably not less than 15 sq.cm. On the other hand, if the surface area is too large, the head weight is excessively increased. Thus, the surface area S2 is preferably set in a range of not more than 60 sq.cm, more preferably not more than 40 sq.cm. In this embodiment, the surface area ratio (S2/S1) is 0.9.

The main body 3 is made of a Ti-6Al-4V titanium alloy, and a lost wax process is utilized to form the main body 3.

The face plate 2 is welded to the periphery of the opening 5 of the main body 3.

Figure 3:
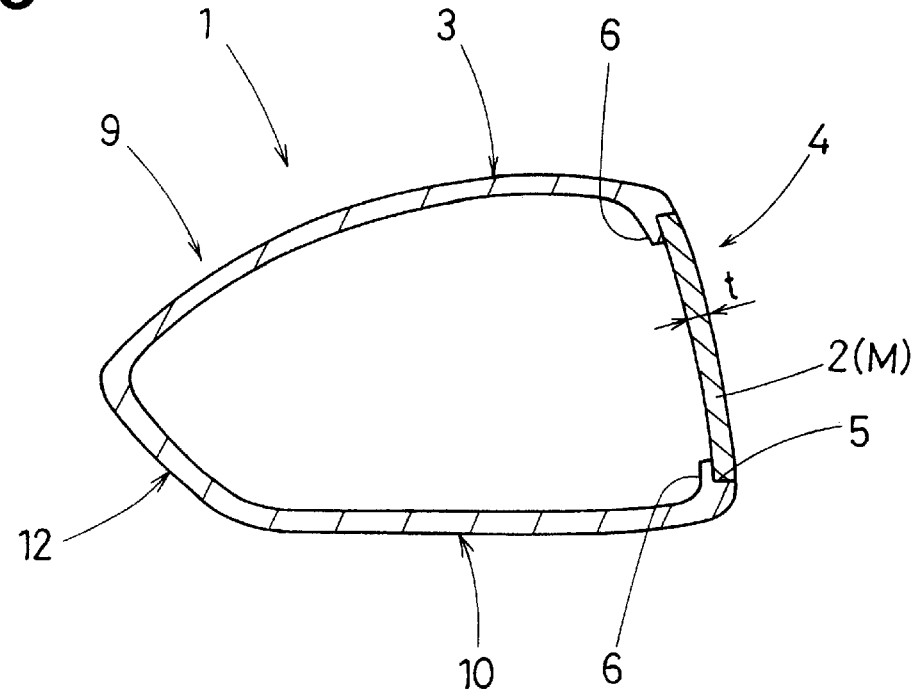
FIG. 3 is a cross sectional view showing another example of the mounting of the face plate.

Preferably, as shown in FIG. 3, the periphery of the opening 5 is provided with a flange 6 to support the back of a circumferential edge of the face plate 2. In this case, aside from the welding, the face plate 2 can be fixed by means of adhesive agent, caulking and the like.

In either case, the main body can be formed as at least two pieces which are united by welding or the like.

In this embodiment, the volume and weight of the head are 300 cu.cm and 195 g, respectively. And the surface area of the face plate 4 is 30 sq.cm.

Wood golf clubs (Ex.1, Ex.2 and Ref.) having the identical structure except for the material of the face plate were made, and the PLM frequency of the head and the ball/head speed ratio were measured. The specifications of the face plates and the test results are shown in Table 2.

TABLE 2

| Club | Ex.1 | Ex.2 | Ref.1 |
|---|---|---|---|
| Head | | | |
| Main body Composition | Ti—6Al—4V | Ti—6Al—4V | Ti—6Al—4V |
| Face plate | | | |
| Composition | $Ti_aZr_bNb_cTa_d$ | $Ti_aZr_bNb_cTa_d$ | Ti—6Al—4V |
| Content (atom %) | a = 50<br>b = 20<br>c = 10<br>d = 20 | a = 60<br>b = 25<br>c = 7.5<br>d = 7.5 | —<br>—<br>—<br>— |
| Element groups | 4 and 5 | 4 and 5 | 4, 5 and 13 |
| Atomic radius difference (%) | 11.7 | 11.7 | 10.2 |
| Heat of mixing (kcal/mol) (major-rest) | Ti—Zr:0<br>Ti—Nb:+0.72<br>Ti—Ta:+0.48 | Ti—Zr:0<br>Ti—Nb:+0.72<br>Ti—Ta:+0.48 | Ti—Al:−14.58<br>Ti—V:−0.72 |
| Volume % of Body-centered cubic solid solution | 100 | 90 | 50 |
| Young's modulus E(GPa) | 40 | 60 | 110 |
| Tensile strength σ f (MPa) | 900 | 1000 | 910 |
| σ f (MPa)/E (MPa) | 0.0225 | 0.0167 | 0.00827 |
| E × t (GPa mm) | 120 | 180 | 330 |
| σ f × t (GPa mm) | 2.7 | 3 | 2.73 |
| Test Result | | | |
| PLM frequency (Hz) | 1062 | 1296 | 1443 |
| Ball/head speed ratio | 1.468 | 1.444 | 1.423 |

Incidentally, the golf clubs were made by fitting the heads with the identical shafts. The golf balls used had a PLM frequency of substantially 1000 Hz. The head speed Hs at the time of hitting the ball was 45 m/s. The hitting was made using a swing robot to which the golf club was fixed. The ball's initial speed Hb was measured to obtain the speed ratio (Hb/Hs).

Figure 4:
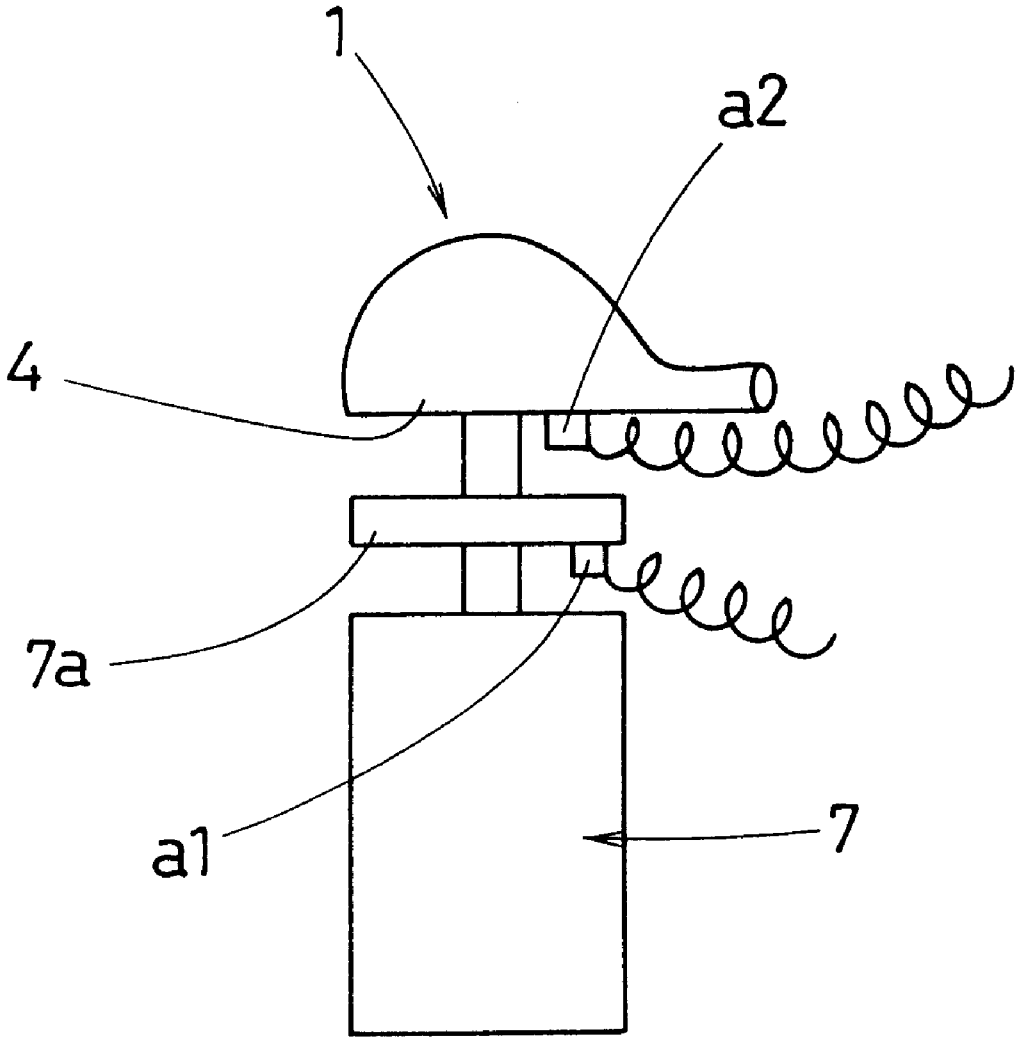
FIG. 4 is a diagram for explaining a method of measuring the mechanical impedance of the golf club head.

As to the PLM frequency, as shown in FIG. 4, the face 4 of the club head 1 was fixed to a sample setting table 7*a* of a vibrator 7 to vibrate the face 4 at a variable frequency. During vibrating the face 4, the acceleration A1 of the vibrator 7 and the acceleration A2 of the face 4 were picked up with acceleration pickups a1 and a2 attached thereto. The outputs of the pickups were entered in a dynamic single analyzer to calculate the mechanical impedance Z=F/V as a function of the frequency to find the PLM frequency, wherein F is the vibrating force which can be obtained by multiplying the acceleration A1 and a constant (m) (F=m× A1), and V is the velocity which can be obtained by integrating the acceleration A2 (V=∫A2).

As shown in Table 2, the PLM frequency of the club heads Ex.1 and Ex.2 approached to the PLM frequency of the golf ball. And the restitution coefficient which is equal to the ratio (Hb/Hs) of the ball initial speed Hb to the head speed Hs was improved.

In case of a wood-shaped golf club head 1, the thickness (t) of the face part or face plate 4 is set in a range of from 2.0 to 4.0 mm. If the thickness (t) is not more than 2.0 mm, the durability of the face part is liable to become insufficient. If not less than 4 mm, the weight of the face part is increased and the freedom of designing the head 1 may be restricted.

As the alloy used in the head 1 according to the present invention has good working properties, the alloy can be used to make the crown 9, sole 10, neck 11 and side 12 in addition to the face part. It is possible to form such parts separately and to formed the head by assembling and welding them together.

Aside from the wood-shaped club head, the present invention can be applied to various golf club heads, e.g., iron-shaped club heads, putter-shaped club heads and the like.

In case of such iron-shaped or putter-shaped club head, the above-mentioned alloy can be used to make the whole of the head, namely the face part and main body. Of course it is possible to make the face part only.

According to further tests conducted by the inventors, in case of iron-shaped heads, by setting the thickness of the face part in a range of from 1.0 to 4.0 mm, it was possible to achieve both the strength and weight in a well-balanced manner.

In case of the iron-shaped heads and putter-shaped heads, it is preferable that the whole of the head or the face part and main body are made of the above-mentioned alloy.

In any case, the iron-shaped, putter-shaped and wood-shaped heads, in order to fully derive the characteristic from the alloy, the back of the face is preferably formed as a closed hollow or an open hollow.

As described above, according to the present invention, the golf club head is provided with the face part made of the special alloy which is, in comparison with the pure titanium or the titanium alloy, high in the tensile strength, considerably low in the Young's modulus, large in the critical elastic elongation, and high in the hardness. Therefore, the PLM frequency of the mechanical impedance of the head can be decreased, while maintaining the sufficient durability and resistance to external injury of the face. As a result, the restitution coefficient at the time of hitting a ball is increased to increase the ball's initial speed, and the leap can be increased.

What is claimed is:

1. A golf club head comprising a face part defining a face for striking a golf ball, at least a part of said face part made of an alloy satisfying the following three conditions:

(1) the alloy is composed of at least three different metallic elements whose group numbers in the periodic system are at least two consecutive numbers;

(2) a difference in the atomic radius between at least two of said at least three different metallic elements is not less than 10%; and (3) the heat of mixing of the element that is the major component of the alloy and at least one of the remaining components is not less than −10 kcal/mol.

2. The golf club head according to claim 1, wherein said alloy contains at least 50 volume % of body-centered cubic solid solution with respect to the entire volume of the alloy.

3. The golf club head according to claim 1 or 2, wherein the alloy is composed of at least one element selected from the group consisting of zirconium Zr and hafnium Hf, whose total atomic percent (x) is more than 0% but less than 50%, at least one element selected from the group consisting of Vanadium V, niobium Nb, tantalum Ta, molybdenum Mo, chromium Cr and tungsten W, whose total atomic percent (y) is more than 0% but less than 50%, and titanium whose atomic percent is 100−(x+y), and the summation (x+y) of the total atomic percent (x) and the total atomic percent (y) is not more than 50%.

4. The golf club head according to claim 1, wherein the ratio (sigma f/E) of the tensile strength of to the Young's modulus E of the alloy is in the range of from 0.0125 to 0.030.

5. The golf club head according to claim 1, wherein the face part is made of the alloy having a thickness of from 1.0 to 4.0 mm.

6. The golf head according to claim 1, wherein the face part is formed by a face plate made of the alloy, and the face plate is made through a cold working in which the alloy is subjected to a decrease in the sectional area of at least 10%.

7. The golf club head according to claim 1, wherein the face part is made of the alloy, and the product (Ext) of the Young's modulus E (Gpa) of the alloy and the thickness t (mm) of the face part is in a range of from 40 to 300 (Gpa mm).

8. The golf club head according to claim 1, wherein the face part is made of the alloy, and the product (sigma fxt) of the tensile strength sigma f (Gpa) of the alloy and the thickness t (mm) of the face part is in a range of from 1.0 to 4.0 (Gpa mm).

* * * * *